US007393082B2

(12) United States Patent
Ito et al.

(10) Patent No.: US 7,393,082 B2
(45) Date of Patent: Jul. 1, 2008

(54) IMAGE RECORDING APPARATUS

(75) Inventors: Shingo Ito, Kasugai (JP); Toshio Sugiura, Anjo (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 396 days.

(21) Appl. No.: 11/169,761

(22) Filed: Jun. 30, 2005

(65) Prior Publication Data

US 2006/0001707 A1 Jan. 5, 2006

(30) Foreign Application Priority Data

Jun. 30, 2004 (JP) ..... 2004-193884

(51) Int. Cl.
*B41J 2/14* (2006.01)

(52) U.S. Cl. ..... 347/49

(58) Field of Classification Search ..... 347/37, 347/49, 85, 86

See application file for complete search history.

(56) References Cited

U.S. PATENT DOCUMENTS

| | | | | |
|---|---|---|---|---|
| 5,359,357 | A * | 10/1994 | Takagi et al. | 347/49 |
| 5,500,664 | A | 3/1996 | Suzuki et al. | |
| 5,777,646 | A * | 7/1998 | Barinaga et al. | 347/86 |
| 6,019,460 | A * | 2/2000 | Ushiogi et al. | 347/85 |
| 6,196,665 | B1 * | 3/2001 | Weeks | 347/49 |
| 6,550,899 | B1 | 4/2003 | Cowger et al. | |
| 7,033,009 | B2 * | 4/2006 | Shinada et al. | 347/86 |

FOREIGN PATENT DOCUMENTS

| | | | |
|---|---|---|---|
| CN | 1445094 | A | 10/2003 |
| EP | 0 903 239 | | 3/1999 |
| EP | 0903239 | A2 | 3/1999 |
| JP | 05162335 | | 6/1993 |
| JP | 2003-300330 | A | 10/2003 |
| JP | 2003300330 | | 10/2003 |

OTHER PUBLICATIONS

European Search Report Application No. 05254118; dated Sep. 29, 2005.

Office Action dated Jan. 12, 2007 in Chinese Application No. 200510081097.4.

* cited by examiner

*Primary Examiner*—Anh T. N. Vo
(74) *Attorney, Agent, or Firm*—Banner & Witcoff, Ltd

(57) ABSTRACT

An image recording apparatus includes an ink cartridge having an ink storage section and an ink outlet port; a holder to which the ink cartridge is detachably attached; a recording section to which the ink is supplied through an ink tube coupled to the holder; a cartridge coupling section being on a bottom of the holder and communicating with the ink outlet port to draw the ink cartridge when the ink cartridge is attached to the holder; a lock arm body provided on the bottom of the holder, the lock arm body having an engagement lug retaining unremovably the ink cartridge; and a urging member formed by a spring elastic body to be engagable with the lock arm body. The forcing member urges the engagement lug of the lock arm body to engage the engagement lug with the ink cartridge attached to the holder.

19 Claims, 16 Drawing Sheets

IMAGE RECORDING APPARATUS

BACKGROUND OF THE INVENTION

1. Field of the Invention

The present invention relates to an image recording apparatus, and more particularly, to an ink supply structure employed when ink is supplied from ink cartridges to a recording section.

2. Description of the Related Art

Conventionally, when an ink cartridge is disposed on a recording head, an inkjet printer becomes bulky with respect to a heightwise direction. For this reason, a known inkjet printer includes an ink cartridge, such as a cartridge-type ink tank, that is separated from a recording head (JP-A-2003-300330(see FIGS. 1, 6)).

In this printer, the ink cartridge has an ink storage section, and an ink outlet hole formed in a bottom surface of the ink storage section. An ink supply needle which can be inserted into the ink outlet hole of the ink cartridge is provided on a bottom section of a top-face-opened holder (a cartridge placement section) of a printer main body. An ink tube, which is connected at one end thereof to the ink supply needle, is connected to a recording head on a carriage which can reciprocally travel in a main scanning direction.

However, the image recording apparatus disclosed in JP-A-2003-300330 is not equipped with a device for unremovably retaining the ink cartridge attached to the holder. Therefore, when the image recording apparatus is inclined or the like, the ink supply needle might come off the ink outlet hole of the ink cartridge, which in turn causes entry of outside air into the ink cartridge. Subsequently, at the time of supply of ink, air is fed into the recording head along with ink through the ink tube. As a result, there arises a problem of deterioration of a recorded image, such as inaccurate ejection of ink from the recording head during image recording operation.

As described in JP-A-2003-300330, a needle section (needle-like projection section) used for establishing communication with the atmosphere is provided upright on the bottom of the holder in substantially parallel to the ink supply needle.

When ink is sucked from the ink storage section of the hermetic ink cartridge, the ink storage section is brought to a negative pressure (i.e., a pressure equal to atmospheric pressure or less), thereby ink supply operation cannot be continued. For this reason, the ink storage section is opened to the atmosphere through the atmosphere open hole formed in the ink cartridge. In this case, the structure is configured such that, when the ink cartridge is generally attached to the holder, a sealing film affixed to a recess section, or the like, which is formed in the bottom surface of the ink cartridge for opening the ink cartridge to the atmosphere is first broken; and such that, before the ink outlet hole is connected to the ink supply needle, the liquid surface of ink stored in the ink storage section within the ink cartridge is subjected to the atmospheric pressure, to thus smoothly supply ink to the ink tube or the inside of the recording head.

To that end, the attitude of the inserted ink cartridge must be regulated or guided so that, when the ink cartridge is inserted into the holder, at least the bottom surface of the ink cartridge can be inserted in parallel to the bottom surface of the holder and at least the sealing film can come close to the needle section (needle-like projection section) to communicate with the atmosphere, to thus break the sealing film. Such means is not taken into consideration by the related art.

SUMMARY OF THE INVENTION

The present invention has been conceived to solve the problems mentioned above. It is an object of the invention to provide an image recording apparatus having an ink cartridge holder into which an ink cartridge can be inserted appropriately without deteriorating a quality of a recorded image.

According to one aspect of the invention, there is provided an image recording apparatus including: an ink cartridge having an ink storage section and an ink outlet port from which ink is to be taken; a holder to which the ink cartridge is detachably attached; a recording section to which the ink is supplied through an ink tube coupled to the holder; a cartridge coupling section provided on a bottom of the holder, the cartridge coupling section communicating with the ink outlet port to draw the ink from the ink cartridge when the ink cartridge is attached to the holder; a lock arm body provided on the bottom of the holder, the lock arm body having an engagement lug retaining unremovably the ink cartridge attached to the holder; and an urging member formed by a spring elastic body to be engageable with the lock arm body, wherein the urging member urges the engagement lug of the lock arm body to engage the engagement lug with the ink cartridge attached to the holder.

Accordingly, in addition to the engagement lug of the lock arm body, the urging force generating from the urging member made of the spring elastic body acts on the ink cartridge, thereby increasing the force for making dislodgment of the ink cartridge impossible. Accordingly, even in the case of a configuration in which the rigidity of the lock arm body is small, the ink cartridge can be sturdily fixed and retained. Hence, the holder can be made easily and can be made compact.

There is an advantage of prevention of intrusion of air into the ink cartridge or the recording head, which would otherwise be caused by inadvertent removal or inclination of the ink cartridge from the main body of the image recording apparatus, thereby preventing deterioration of the quality of a recorded image.

According to another aspect of the invention, the forcing member includes a first end potion, a second end portion, and an intermediate portion. The first end portion is latched to a back face of the engagement lug of the lock arm body. A bending portion formed between the intermediate portion and the second end portion is latched to a restraint area provided on a base portion of the holder.

Accordingly, the spring elastic body can be attached to the holder later, which in turn facilitates an assembly operation and enables arbitrary setting of the elastic modulus for the form of the spring elastic body.

According to another aspect of the invention, the holder is formed into a single molded article to have an accommodating recess which is capable of accommodating the ink cartridge. The lock arm body is provided upright on the bottom of the holder and adjacent to the accommodating recess.

Accordingly, there is also yielded an advantage of the ability to form the holder and the lock arm body into a single molded article made of synthetic resin, and an advantage of obviation of necessity for enhancing rigidity of the lock arm body. Hence, even when the lock arm body is formed into a smaller thickness, no inconvenience is yielded.

According to another aspect of the invention, the ink cartridge has, in its surface to be faced with the holder, the ink outlet port and an air inlet port for taking air from outside. The accommodating recess of the holder has, in its bottom surface, the cartridge coupling section to be connected to the ink outlet port and an air introduction section to be connected to the air inlet port.

Accordingly, the ink cartridge is removably attached to the main body of the image recording apparatus from above, thereby facilitating operation for replacing an ink cartridge.

According to another aspect of the invention, the image recording apparatus further includes: a middle case; and a lower case, wherein the holder is fixedly interposed between the lower case and the middle case. A guide rib is formed closer to the air introduction section than to the cartridge coupling section on at least one of the holder and the middle case to guide the ink cartridge to be inserted straight into the accommodating case.

Accordingly, when being inserted from above, the ink cartridge can be guided so as to assume a correct position, which in turn reliably prevents intrusion of external air into the ink storage section of the ink cartridge and deterioration of a recorded image.

According to another aspect of the invention, a regulation section for preventing erroneous insertion of the ink cartridge is provided on at least one of the holder and the middle case.

Accordingly, erroneous operation (erroneous insertion), which would otherwise be caused when the inserting orientation of the ink cartridge is wrong, is reliably prevented, thereby preventing occurrence of fracture of components of the main body of the image recording apparatus or the like.

BRIEF DESCRIPTION OF THE DRAWINGS

These and other objects and advantages of this invention will become more fully apparent from the following detailed description taken with the accompanying drawings in which.

DESCRIPTION OF THE PREFERRED EMBODIMENTS

Embodiments of the present invention will be described by reference to FIGS. 1 through 17.

Figure 1:
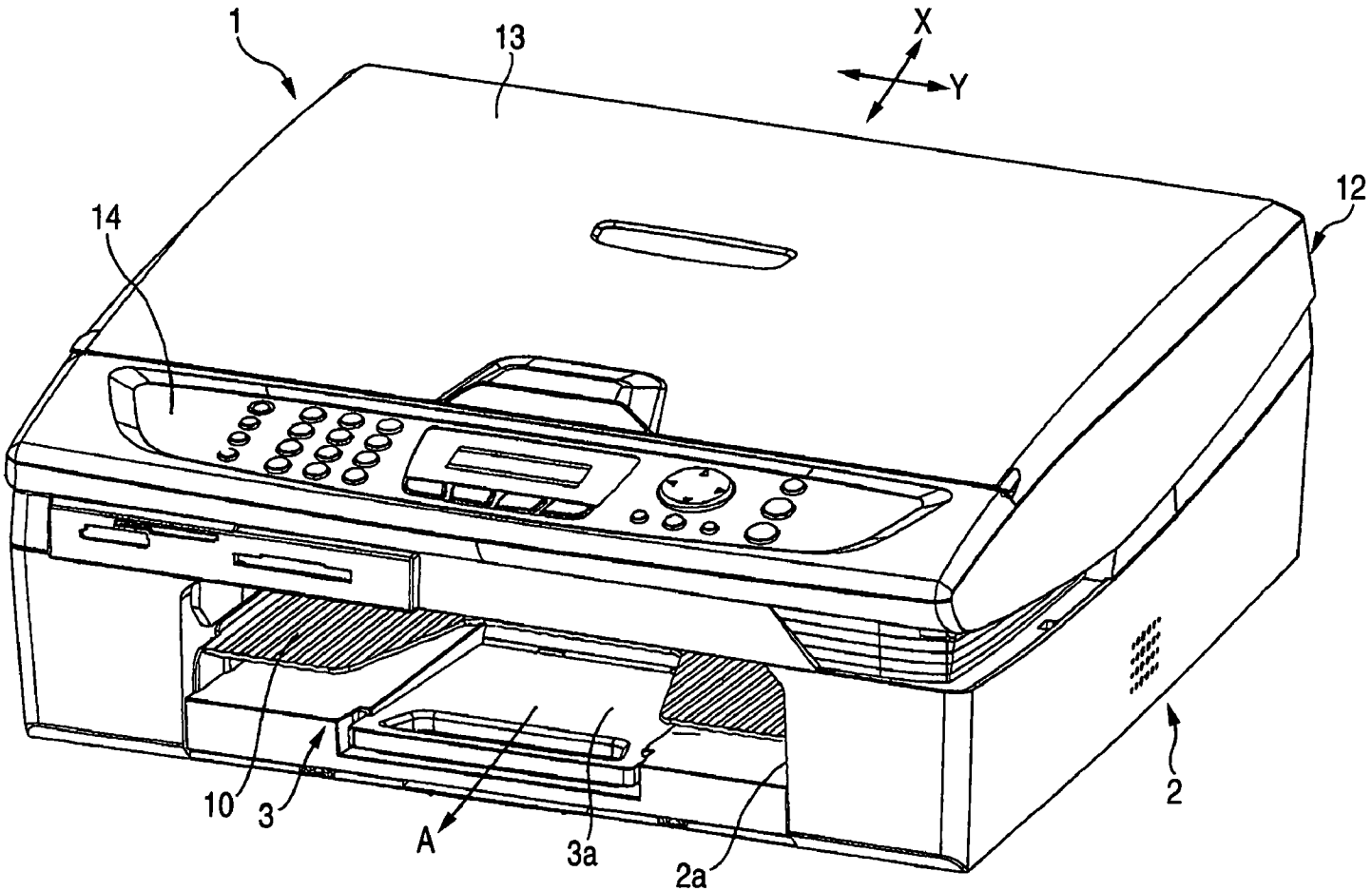
FIG. 1 is a perspective view of an image recording apparatus according to the first embodiment of the invention.
Figure 2:
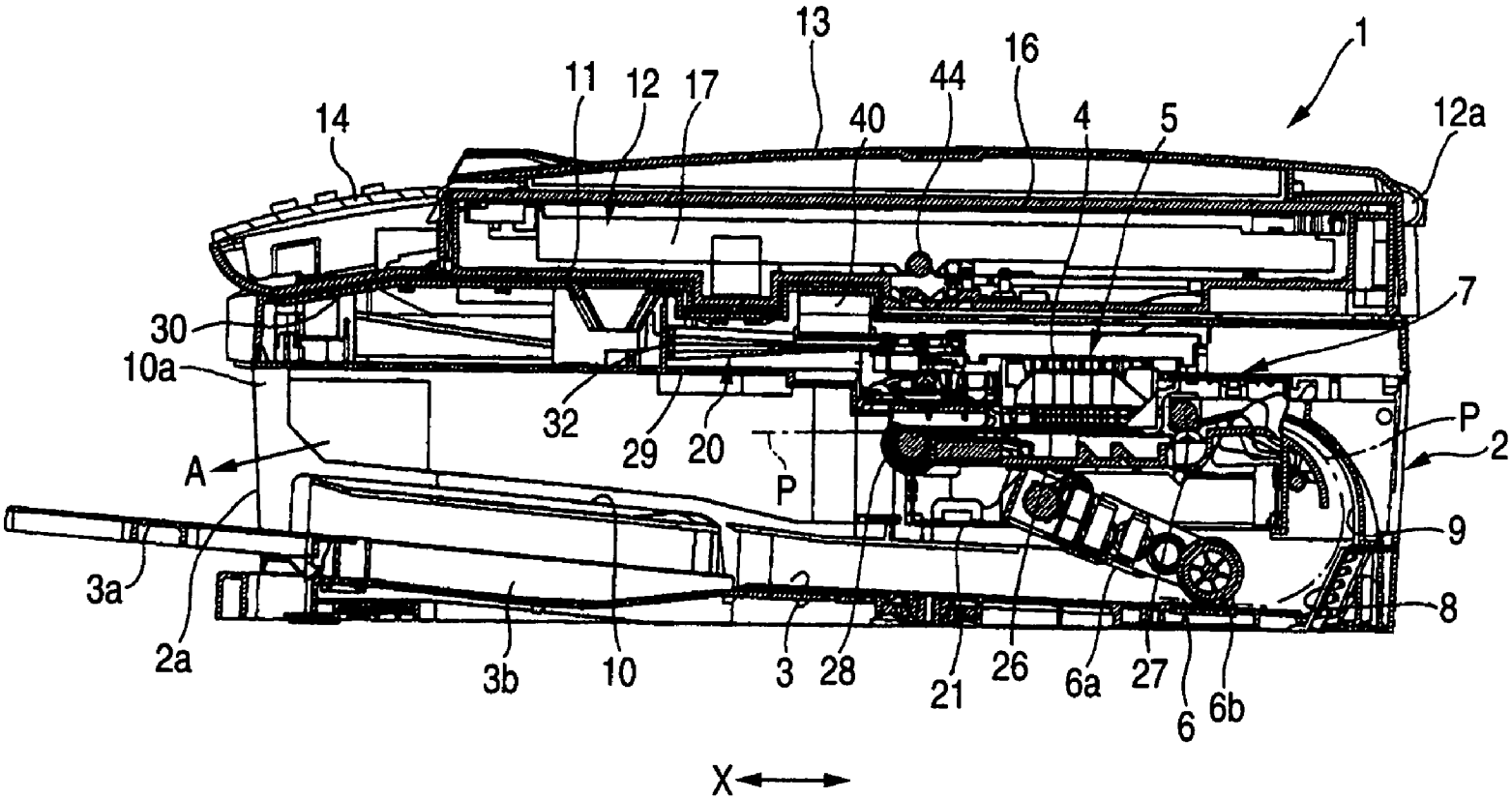
FIG. 2 is a side cross-sectional view of the image recording apparatus.
Figure 3:
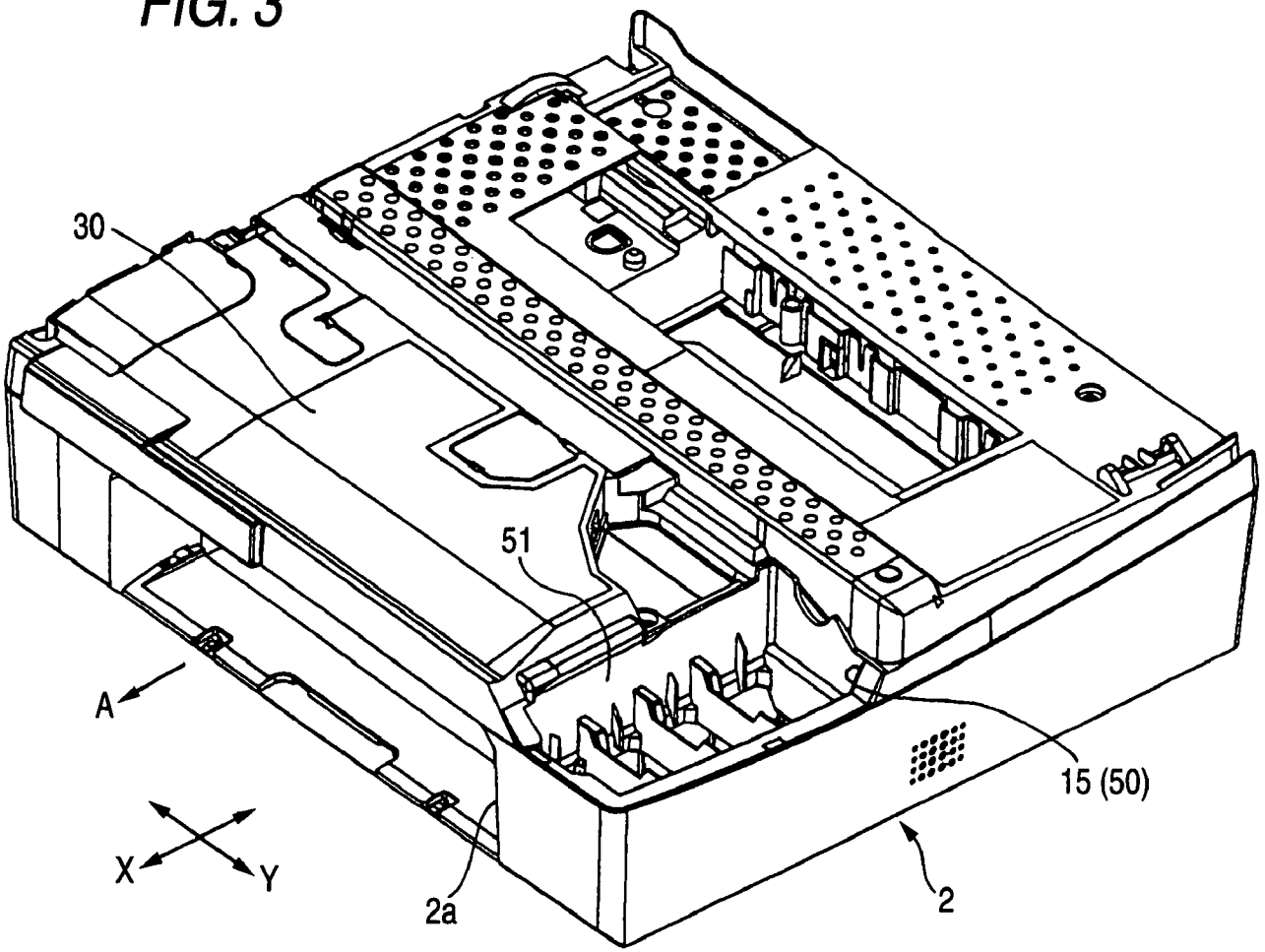
FIG. 3 is a perspective view of the image recording apparatus with an image reader removed.
Figure 4:
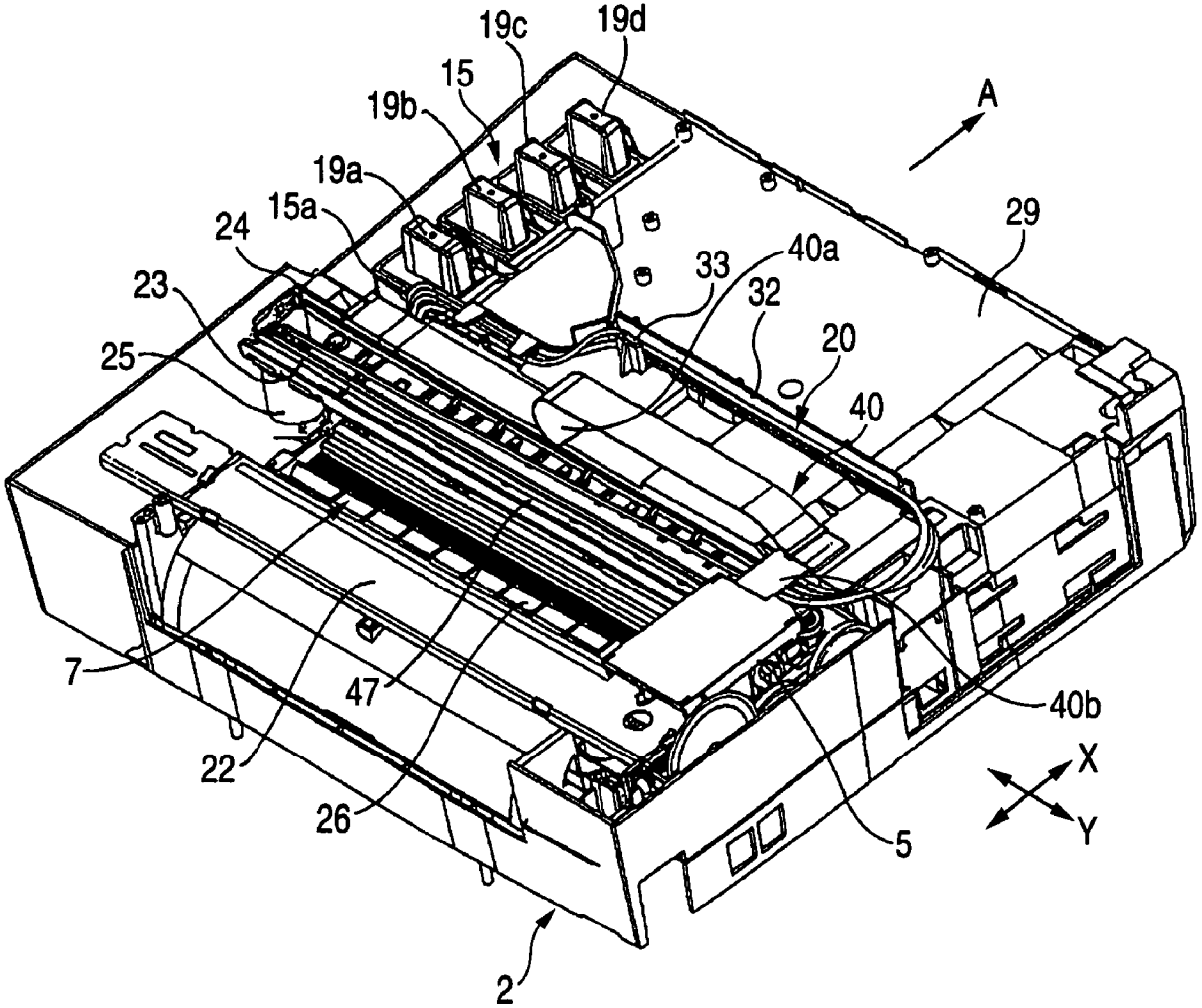
FIG. 4 is a perspective view of the image recording apparatus with an upper cover body 30 removed.
Figure 5:
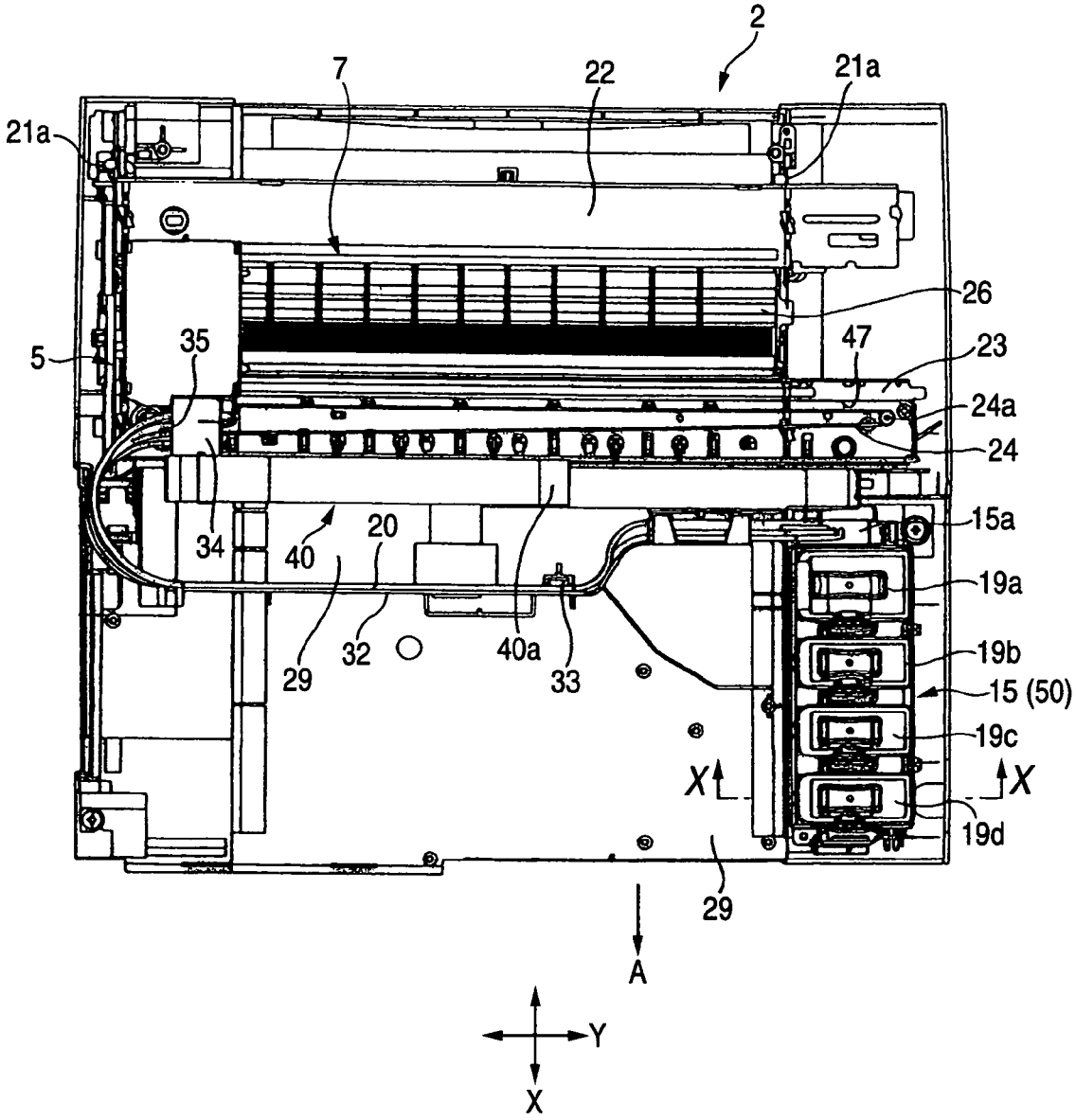
FIG. 5 is a plan view corresponding to FIG. 4.
Figure 6:
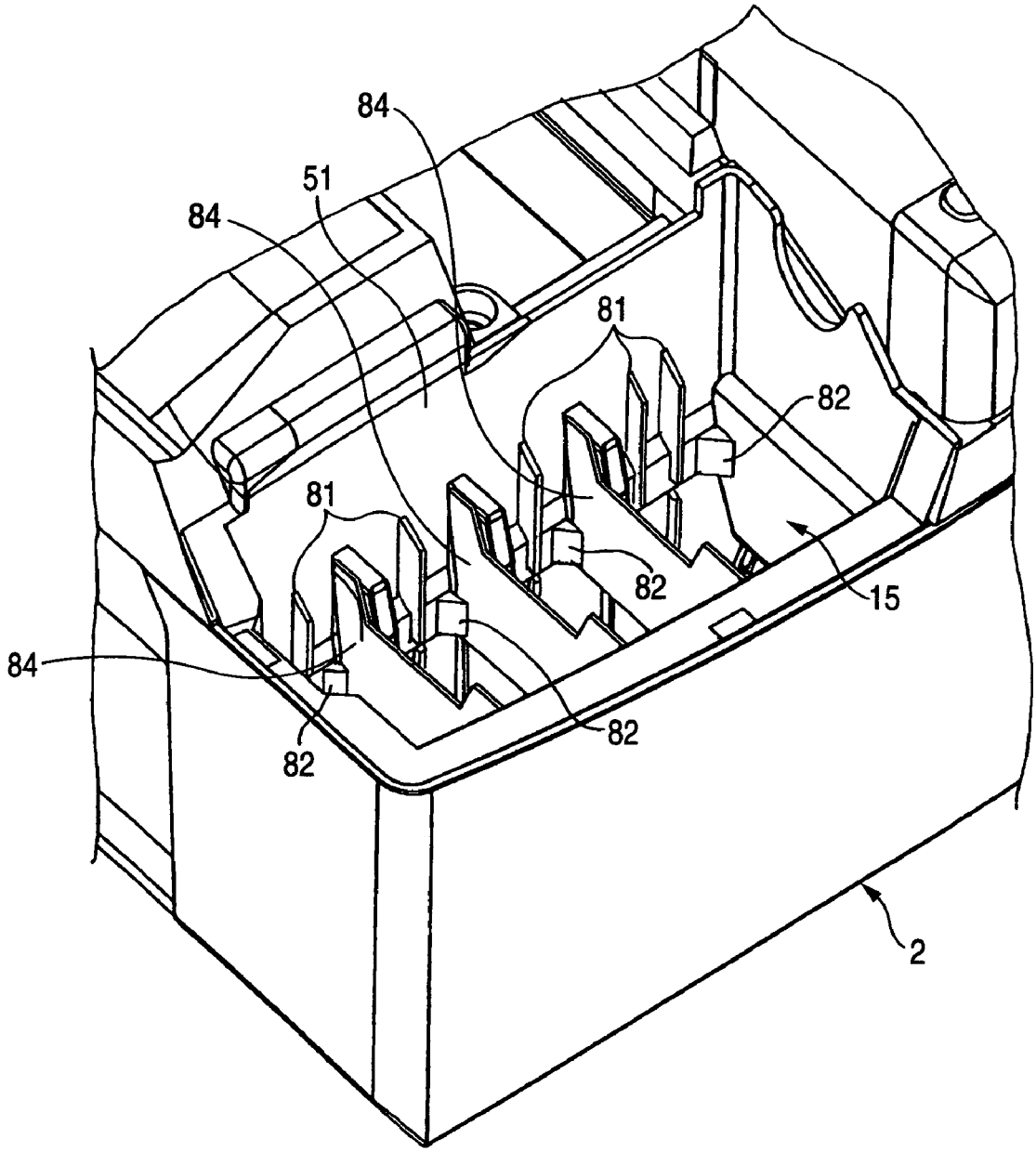
FIG. 6 is an enlarged perspective view of an ink storage section.

A first embodiment will be explained by reference to FIGS. 1 through 15. FIG. 1 is a perspective view of a multifunction machine applied to the first embodiment when the multifunction machine is viewed from the front; FIG. 2 is a side cross-sectional view of the same; FIG. 3 is a perspective view of the multifunction machine with an image reader 12 removed therefrom when the multifunction machine is viewed from the front; FIG. 4 is a perspective view of the multifunction machine when a recording section with an upper cover member removed therefrom is viewed from the rear; FIG. 5 is a plan view of the recording section or the like; and FIG. 6 is a perspective view of the recording section when viewed from the rear.

An image recording apparatus 1 of the first embodiment corresponds to a multifunction device (MFD) having a printer function, a copier function, a scanner function, and a facsimile function. As shown in FIG. 1, a paper feed cassette 3, which can be inserted through an opening section 2*a* formed in the front side (the left side in FIG. 1) of a housing 2, is arranged on a bottom section of the housing 2 of the apparatus. The housing serves as a recording apparatus main unit made of synthetic resin.

In the first embodiment, the paper feed cassette 3 is formed to enable paper P—serving as a recording medium and being cut into, e.g., an A4 size, a letter size, a legal size, or a postcard size—to be housed while being piled (stacked) into a plurality of layers such that shorter sides of the paper extend in a direction (a direction orthogonal to the paper of FIG. 1, the main scanning direction, or the direction of the Y axis) orthogonal to a paper transport direction (a sub-scanning direction or the direction of the X axis) (see FIG. 1). An auxiliary support member 3*a* supporting a distal end portion of long paper P of, e.g., a legal size, is attached to the front end of the paper feed cassette 3 so as to be movable in the direction of the X axis. FIG. 2 shows that the auxiliary support member 3*a* is arranged at a position where the support member projects outside the recording apparatus main body 2. When paper P of A4-size or the like which fits into the paper feed cassette 3 (which does not project to the outside of the housing 2 from the opening section 2*a*) is used, the auxiliary support member 3*a* can be housed in a housing section 3*b* so as not to hinder feeding of paper.

A bank section 8 separating paper is disposed at an inner deep position (a deep right-side position in FIG. 2) in the paper feed cassette 3. An arm 6*a* whose upper end section is pivotable in a vertical direction is attached to the housing 2. The paper P, which is a recording medium piled (stacked) on the paper feed cassette 3 is separately transported piece by piece by the paper feed roller 6 attached to the lower end of the arm 6*a* and the bank section 8. The thus-separated paper P is fed to a recording section 7 disposed at a rear position higher than the paper feed cassette 3 (an elevated position) through a vertically-and-horizontally-oriented U-turn path (a paper feed path) 9. As will be described in detail later, the recording section 7 is formed from a carriage 5, or the like, which is equipped with an inkjet recording head 4 for implementing a printer function and can move reciprocally.

A paper output section 10 on which the paper P recorded by the recording section 7 is output while a recorded surface of the paper is oriented upward is formed on an upper side of the paper feed cassette 3. A paper output port 10*a* which is in communication with the paper output section 10 is opened toward the front surface of the housing 2.

The image reader 12 used for reading an original by the copy function and the facsimile function is placed on top of the housing 2. A bottom wall 11 of the image reader 12 is configured so as to be superposed on an upper cover body 30 from the above without leaving any substantial clearance therebetween. The image reader 12 is configured so as to be able to reclosably rotate around one side edge of the housing 2 in the vertical direction through an unillustrated pivot section. Moreover, a rear end of an original cover body 13 covering an upper surface of the image reader 12 is attached to a rear end of the image reader 12 so as to be vertically pivotable about an axis 12*a*.

A control panel section 14 equipped with various control buttons, a liquid-crystal display section, or the like is provided at a position which is above the housing 2 and forward of the image reader 12. The recording section 7, the paper output section 10, and an ink storage section 15 disposed on one side of the paper output section 10 are situated within a projected area of the image reader 12 and the control panel section 14 in the plan view. In a state where the auxiliary support member 3*a* is housed in the housing section 3*b*, the length of the paper feed cassette 3 in the direction of the X axis becomes substantially equal to the total length of the image reader 12 and the control panel section 14 in the direction of the X axis. Accordingly, the image recording apparatus 1 assumes the shape of a substantially rectangular prism which is substantially square when viewed from the top. For this reason, even at the time of packaging of the image recording apparatus for shipping the apparatus as a product, packaging operation is facilitated, thereby enabling miniaturization of a package box.

Amount glass plate 16 on which an original can be placed by upwardly opening the original cover body 13 is placed on the upper surface of the image reader 12. An image scanner for reading an original (CIS: Contact Image Scanner) 17 is disposed below the mount glass plate 16 so as to be able to reciprocally move in a direction orthogonal to the paper plane of FIG. 2 (i.e., a main scanning direction or the direction of the Y axis in FIGS. 3 to 5).

As shown in FIGS. 2, 4, and 5, the recording section 7 is supported by a pair of right and left side plates 21*a* of a main frame 21 made from a metal plate or the like. The recording section 7 comprises horizontally-oriented plate-like guide members 22, 23 which extend in the direction of the Y axis (the main scanning direction); the carriage 5 which is slidably supported (carried) while straddling the guide member 22 and a guide member 23 and can reciprocally move; a timing belt 24 which is arranged in parallel with an upper surface of the guide member 23 disposed downstream with respect to the paper transport direction (the direction of arrow A) to reciprocally actuate the carriage 5 with the recording head 4 mounted thereon; a CR (carriage) motor 25 (which is a DC motor in the embodiment but may be embodied by another motor such as a stepping motor) for driving the timing belt 24; a plate-like platen 26 for supporting the paper P which is transported along the lower surface of the recording head 4; and an encoder strip 47, or the like, which is arranged so as to extend in the main scanning direction and detects the position of the carriage 5 with respect to the direction of the Y axis (the main scanning direction). This swath encoder strip 47 is arranged such that an inspection surface thereof (a surface in which slits are formed at given intervals in the direction of the Y axis) is aligned to the vertical direction.

A pair of registration rollers 27 are arranged upstream with respect to the transport direction with the platen 26 interposed therebetween and feed the paper P toward the lower surface of the recording head 4. A spur (not shown) which is to contact the upper surface of the paper P and a paper output roller 28 disposed on the lower surface side of the paper are disposed downstream of the platen 26. The recorded paper P is transported to the paper output section 10 (see FIG. 2).

An ink receiving section (not shown) is disposed, outside the width of the paper P to be transported (i.e., a shorter side of the paper P), at one end of the paper (an area close to the left side plate 21*a* shown in FIG. 4 in the present embodiment). A maintenance unit (not shown) is also disposed at the other end of the paper (an area close to the right side plate 21*a* in FIG. 4). By this configuration, at a flashing position set in the ink receiving section the recording head 4 periodically ejects ink for preventing occurrence of clogging during the course of recording operation, and the thus-ejected ink is received by the ink receiving section. In the maintenance unit area, the carriage 5 remains at a standby position, where a nozzle surface of the recording head 4 is cleaned or there is performed recovery operation, or the like, for selectively sucking ink on a per-color basis or eliminating air bubbles from the inside of an unillustrated buffer tank provided on the recording head 4.

A lower cover body 29 made of a metal plate is also provided to cover a space above the paper output section 10 from the lower surface of the guide member 23 disposed downstream with respect to the paper transport direction to the paper output port 10*a* provided at the front end of the housing 2 (see FIGS. 2 and 4). An upper cover body 30 is provided, while being upwardly spaced from the lower cover body 29 as appropriate, to cover a space above the carriage 5 and the path a long which the carriage 5 reciprocally travels (see FIGS. 2 and 3).

The ink storage section 15, which will be described in detail later, is opened toward a space above the housing 2 (lower case). An upwardly-opened box-shaped holder 50 in the ink storage section 15 is arranged such that the holder is fixedly placed within a housing recess section 2*b* formed in the bottom of the housing 2 (see FIG. 10) and an upper outer peripheral edge of the holder 50 is fixed, in a surrounded manner, by a frame body 51 (middle case) attached to the side of the upper cover body 30 (see FIGS. 3 and 6).

As will be described in detail later, the holder 50 of the ink storage section 15 is configured to be able to: house, in one line in the direction of the X axis, substantially-rectangular-box-shaped ink cartridges 19 and enable removal and attachment of ink cartridges from above. In FIGS. 2 to 4, individual colors; that is, a black (BK) ink cartridge, a cyan (C) ink cartridge, a magenta (M) ink cartridge, and a yellow (Y) ink cartridge are assigned reference numerals 19*a* to 19*d*]. The ink cartridges 19 respectively store ink of four colors for full color recording, and each of them has a small area when viewed from above and a high height.

Figure 7:
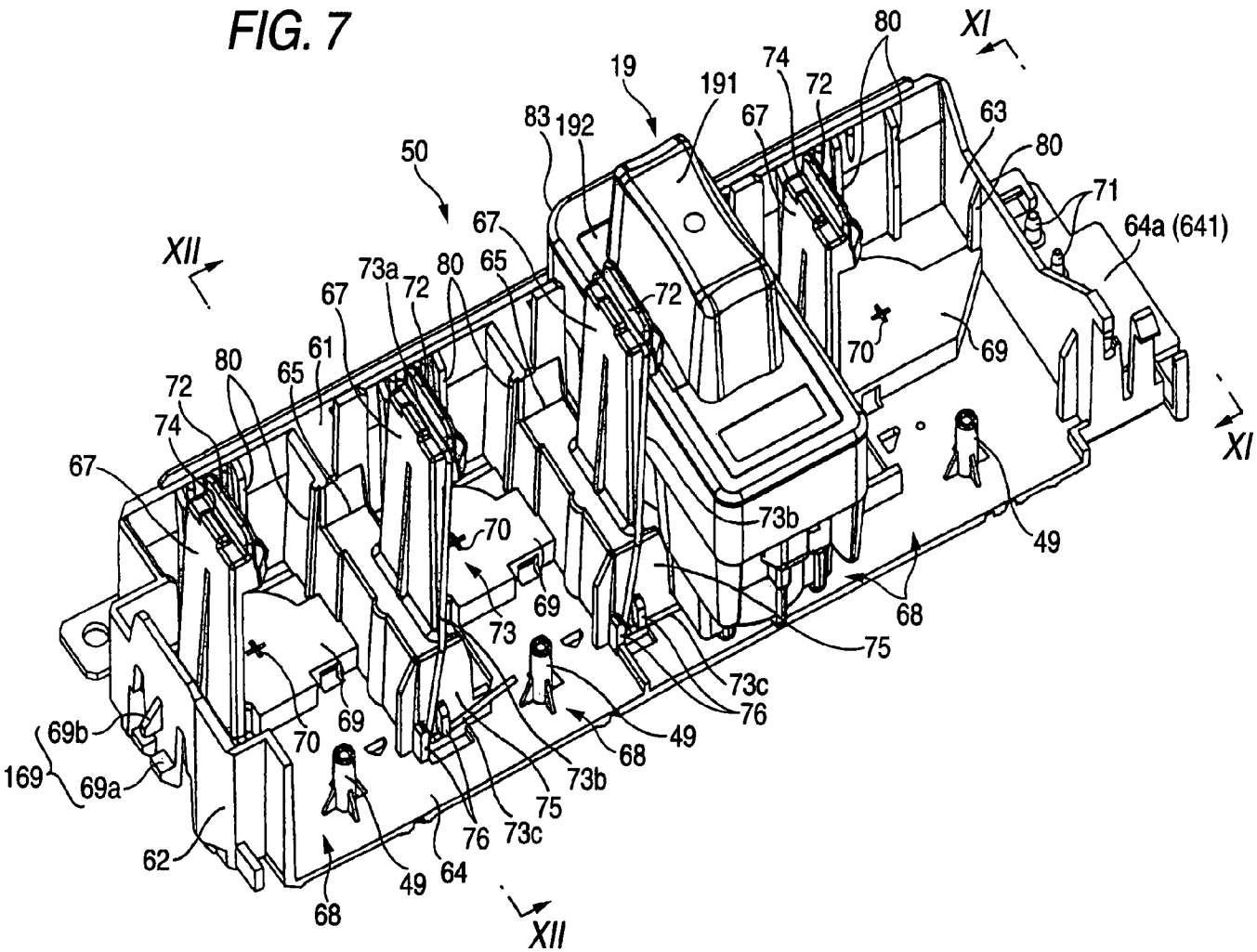
FIG. 7 is a perspective view of a holder.

Ink is supplied to the inkjet recording head 4 from the respective ink cartridges 19 (individual ink cartridges are indicated by reference numerals 19*a* to 19*d*) through a plurality of (four in the embodiment) ink supply tubes (ink tubes) 20 (see FIG. 7). When colors of ink (six to eight colors or the like) which are greater in number than four colors are used, the essential requirement for configuration is to enable the ink storage section 15 to house ink cartridges which are equal in number to the colors of ink and to increase the number of ink supply tubes 20 corresponding to the number of ink cartridges. Tip ends of the respective ink supply tubes 20 are connected to a coupling section 35 in a coupling piece 34 located at the base of the carriage 5.

As shown in FIGS. 4 and 5, the basal portions of the plurality of (four in the embodiment) ink supply tubes 20 are bundled at one end portion 15*a* of the ink storage section 15, and the thus-bundled basal portions extend over the upper surface of the lower cover body 29 from one side end (a right end in FIG. 5) to the other end (a left end in FIG. 5) in the direction of the Y axis. At this time, the basal portions of all the ink supply tubes 20 are arranged in a row on the upper surface of the substantially-horizontal lower cover body 29. At least some (at midpoints or the like) of the ink supply tubes 20 are supported by the upper surface of the lower cover body 29.

All of the ink supply tubes 20 are twisted in such a way that their middle portions run along one longitudinal surface (a substantially vertical surface) of a vertical, horizontally-oriented partition 32 of the lower cover body 29. The middle portions of all the ink supply tubes 20 are fixed (held or nipped), while being aligned vertically, between the one longitudinal surface of the longitudinal partition 32 and a longitudinal plate-like fixing body 33 made from synthetic resin and fastened by screws, or the like, to oppose the one longitudinal surface. An area where all of the ink supply tubes 20 are fixed (held) between the fixing body 33 and one longitudinal surface of the longitudinal partition plate 32 corresponds to an intermediate fixed section. The intermediate fixed section may be configured such that the middle portions of all the ink supply tubes 20 are aligned vertically and fixed (held or nipped) in a downwardly/upwardly-oriented U-shaped fixing body (not shown).

A flexible flat cable 40 is for transmitting, from an unillustrated control section provided on the recording apparatus main body 2, a command signal for causing the recording head 4 mounted on the carriage 5 to selectively eject ink droplets from nozzles of the recording head. This flexible flat cable 40 is laid, in substantially parallel to the extending direction of the ink supply tubes 20, in an area (a movable area, an untied area, or an unconstrained area) where the ink supply tubes 20 pass when the carriage 5 reciprocally travels in the direction of the Y axis (the main scanning direction). A tip end section 40*b* of the flexible flat cable 40 extends up to and is coupled to the coupling piece of the carriage 5 (see FIG. 4).

The curved middle portions of the ink supply tubes 20 and the curved middle portion of the flexible flat cable 40 are set such that the convexly curved portions face in opposite directions with respect to the reciprocally traveling direction of the carriage 5. Put another way, the direction in which the ink supply tubes 20 extend with respect to the coupling section 35 of the carriage 5 is set so as to oppose the direction in which the flexible flat cable 40 extends with respect to the carriage 5. Moreover, the flat cable 40 is curvedly formed so as to be inverted at a middle portion 40*a* within a space defined between the upper and lower cover members 30, 29 (see FIG. 4)

By this configuration, the ink supply tubes 20 and the flexible flat cable 40 can be arranged substantially level with each other (within substantially the same horizontal plane) with respect to the vertical direction. Consequently, the overall image recording apparatus 1 can be made slim.

By reference to FIGS. 3 to 14, the configuration of the ink cartridge 19 and that of the holder 50 will be described in detail.

Figure 10:
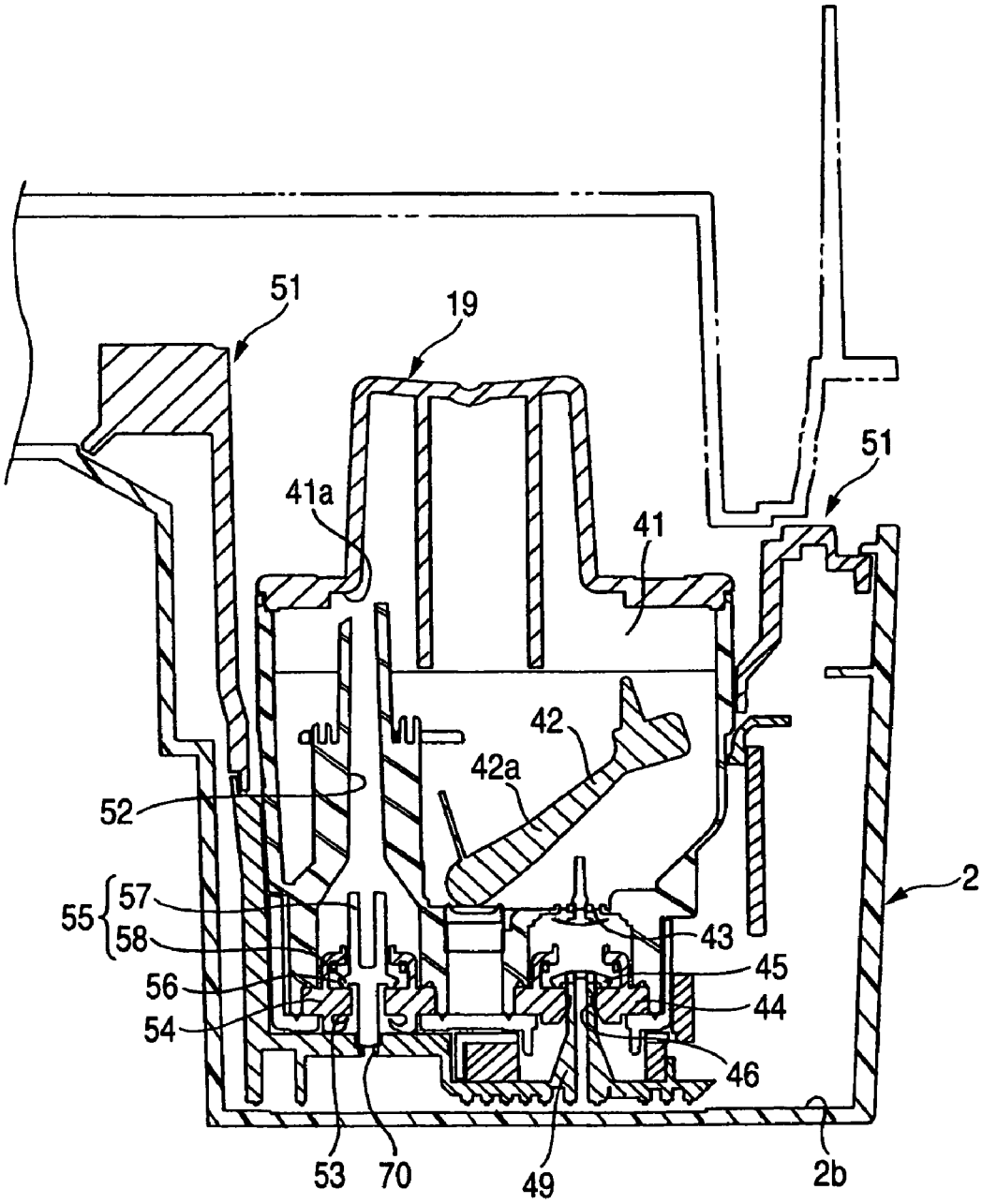
FIG. 10 is an enlarged cross-sectional view taken along line X-X shown in FIG. 5.

When each of the ink cartridges 19 assumes a box shape, the inside of the ink cartridge 19 is formed into an ink chamber 41 to be filled with ink. As shown in FIG. 10, a float 42 is provided within the ink chamber 41. The float 42 is arranged to be able to incline about the center of a hinge 42*a* and changes its attitude in accordance with the level of remaining ink (the height of an upper surface of ink). The level of the ink remaining in the ink cartridge 19 can be ascertained by detecting the position of the tip end of the float 42 through use of a sensor (not shown) attached to the holder 50. The position of the float 42 shown in FIG. 10 corresponds to a depleted state of ink. When the ink is filled, the float 42 assumes an upright attitude.

An ink supply port 43 which is in communication with the ink chamber 41 and an air tower 52 are formed side by side in a lower portion of the ink cartridge 19. This ink supply port 43 is opened downward, and an ink packing 44 having a normally-closed first valve body 45 is housed in the ink supply port 43. An ink outlet port 46, which is normally closed by the first valve body 45, is provided in the center of the ink packing 44 (these elements correspond to an "ink outlet port" of the embodiments). A tip end portion of an ink receiving section 49 (corresponding to an "ink outlet section" of the embodiments), which projects upward from the bottom plate of the holder 50 as will be described later, is inserted into the ink outlet port 46 from below.

The air tower 52 forms a cylindrical shape which vertically penetrates through the ink chamber 41. The upper end part of the air tower 52 is given such a height as to face a ceiling wall 41*a* of the ink chamber 41 and set to a position higher than the upper surface of ink upon initial filling. Therefore, the ink in the ink chamber 41 is set so as not to enter the air tower 52 unless the ink cartridge 19 is inclined.

An air inlet port 53 is provided in a lower portion of the air tower 52. The inner diameter of the air inlet port 53 is set to be larger than that of the remaining portion of the air tower 52, and an air packing 54 having therein a normally-closed second valve body 55 is housed in the air inlet port 53. The second valve body 55 has a rod-shaped main body section 57 which vertically penetrates through an air hole 56 formed in the air packing 54, and a sealing edge 58 which is provided along an outer periphery of the main body section 57 and which closes the air hole 56 as well as the air inlet port 53 when coming into hermetic contact with the upper surface of the opening of the air hole 56.

As shown in FIG. 10, the lower end portion of the main body section 57 of the second valve body 55 remains projecting from the lower surface of the ink cartridge 19 before the ink cartridge 19 is attached to the holder 50. Moreover, a cylindrical lip is provided on the bottom surface of the air packing 54, thereby enclosing the lower end portion of the second valve body 55.

Figure 8:
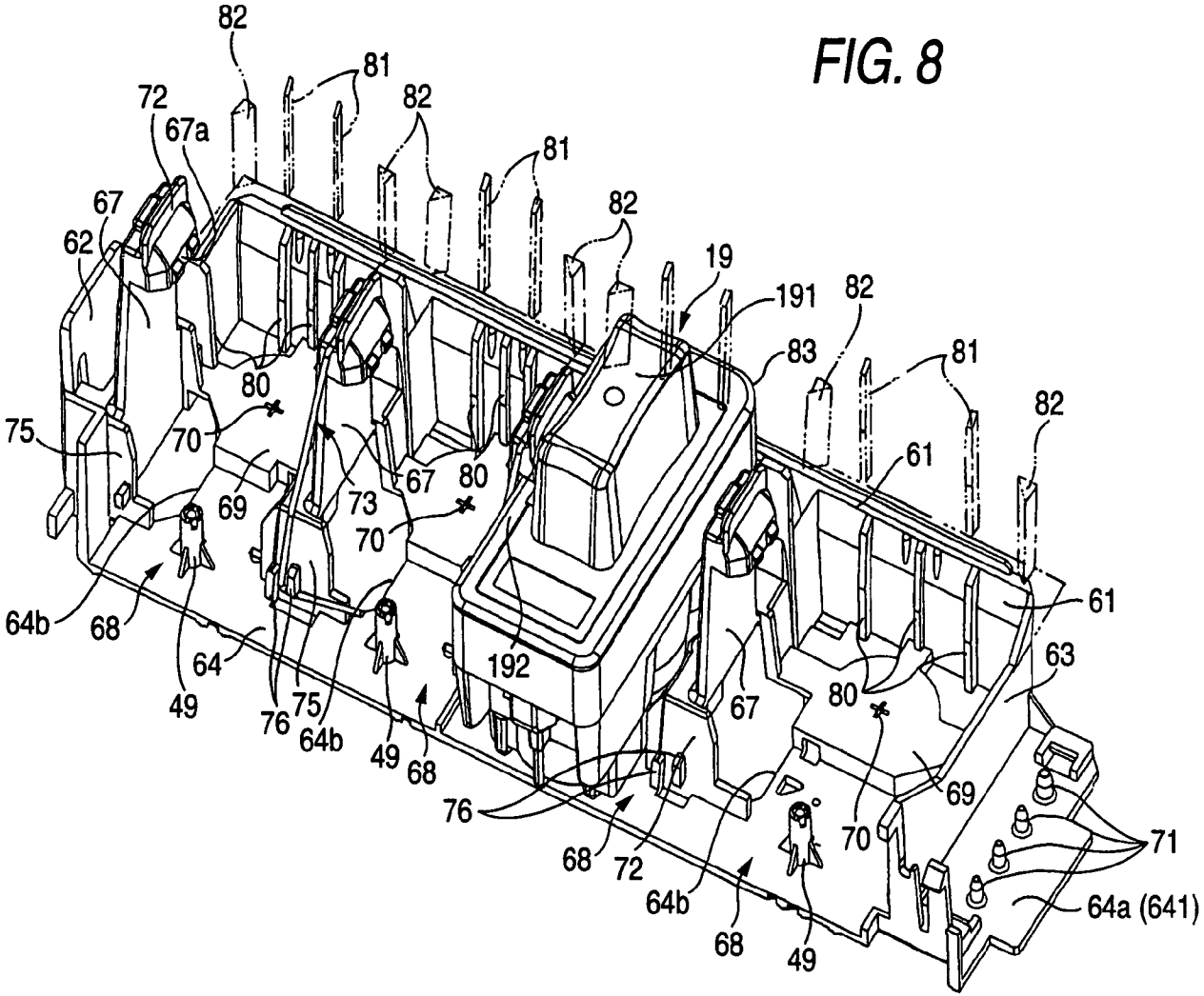
FIG. 8 is a perspective view of the holder viewed from another direction.

Next, the holder 50 that houses the ink cartridges 19 will be described. The holder 50, which is constituted of an article formed from synthetic resin through injection molding, integrally comprises a bottom wall 64; a longitudinal side wall 61; a pair of end walls 62, 63 extending in a direction orthogonal to both ends of the side wall 61; and partition walls 65 parallel to the end walls 62, 63. The holder 50 is formed into the shape of a box whose upper surface and one side are opened. Latch lugs 169, which comprise a guide section 69*a* and a removal-prevention rib 69*b* for fixing the holder 50 with respect to the housing 2 to which the holder 50 is to be attached, are formed in the proximal side wall 62 shown in FIG. 7. As shown in FIG. 8, a right edge (an overhanging section 64*a*) of the bottom wall 64 juts out sideward, and an insert section 641 which is to be inserted into the housing 2 is formed integrally at the tip end portion of the right edge.

Figure 9:
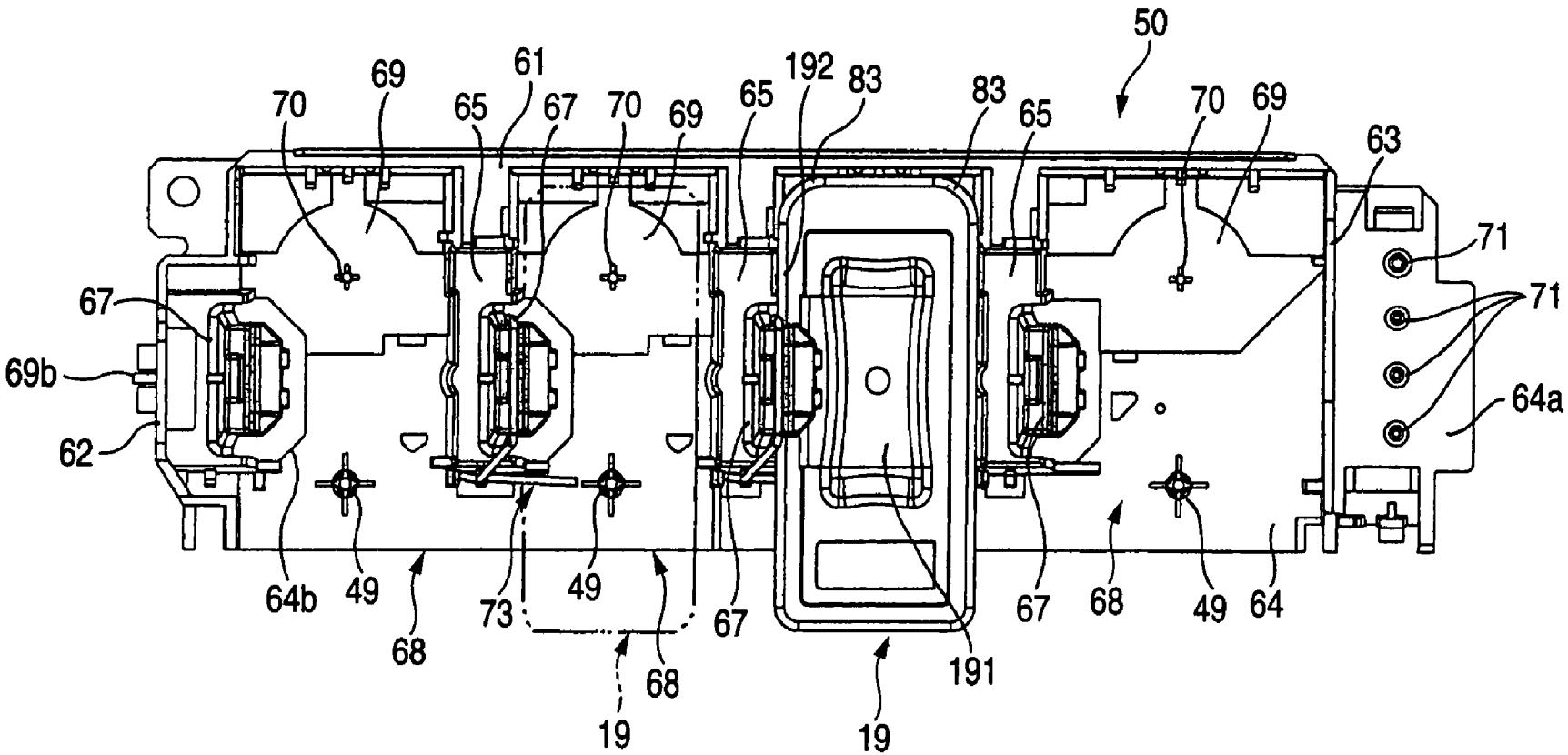
FIG. 9 is a plan view of the holder.

As shown in FIGS. 7 through 9, three partition walls 65 are provided within the holder 50, thereby partitioning the inside of the holder 50 into four cartridge-holding chambers 68. In the embodiment, the three cartridge-holding chambers 68 from the left in FIGS. 7 to 9 are made substantially equal in widthwise dimension to each other, and the right end holding chamber 68 is made slightly wider than the other three holding chambers 68. The ink cartridge 19*a* storing black ink, which is consumed in large quantity, is housed in this wider cartridge holding chamber 68. A plate-like (oblate) ink absorbent (not shown) is laid on the upper surface of the bottom wall 64 of the holder 50 so as to spread over the plurality of cartridge holding chambers 68 (all of the cartridge holding chambers in the embodiment).

Each of the partition walls 65 and one end wall 62 are respectively provided with a lock arm body 67 possessing elasticity. As shown in FIGS. 7 to 9, FIG. 11, FIG. 12, and FIG. 14, the lock arm bodies 67 extend upward in the drawing integrally from the upper wall of the end wall 62 and the upper walls of the respective partition walls 65. Engagement lugs 67*a* which can engage with a step section (engagement section) 192 lower than a pull section 191 of each ink cartridge 19 are formed integrally at the tip portion of the lock arm body 67, thereby preventing removal of the ink cartridge 19 attached to the holder 50. In this case, as shown in FIG. 15, an indented section 193 is formed in a part of the upper surface of the step section (engagement section) 192. When the engagement lug 67*a* is engaged with or disengaged from the indented section 193, a clicking sensation can be provided.

An opening 64*b* appropriate to the outer shape of the engagement lugs 67*a* is provided on the bottom wall 64 of the holder 50. This opening is a release hole allowing opening of a metal mold when the engagement lugs 67*a* are molded.

As shown in FIGS. 7 and 8, the bottom wall 64 of each ink cartridge holding chamber 68 (accommodating recess) has a bearing surface section (air introduction section) 69 whose part facing the air tower 52 in the ink cartridge 19 bulges upward in the drawing. An air intake hole 70 (air introduction section) is bored in the center of the bearing surface section 69. An upper portion of the air intake hole 70 is made slightly wider in diameter than a lower portion of the same. The lower end portion of the second valve body 55 is to butt against the upper portion of the air intake hole 70. When the ink cartridge 19 is attached to the cartridge holding chamber 68 while being oriented in a normal direction, the second valve body 55 butts against the step portion of the air intake hole 70 and, as a result, is lifted upward in the drawing. Thus, the air hole 56 closed by the second valve body 55 is opened.

The height of the bearing surface section 69 is substantially equal to a dimension determined by adding the thickness of the ink absorbent and the thickness of a press plate to be placed on the upper surface of the ink absorbent (neither the ink absorbent nor the press plate is illustrated)

The cylindrical ink-receiving section (cartridge coupling section) 49 is formed integrally, for each cartridge holding chamber 68, at a position on the bottom wall 64 opposing the ink supply port 43 of the ink cartridge 19. The outer dimension of the tip end of the ink-receiving section 49 is set so as to be slightly larger than the inner diameter of the ink outlet port 46. A guide taper is formed along the hole edge of the ink outlet hole 46 (see FIG. 10). When the ink-receiving section 49 is pressed into the ink packing 44 with some degree of press-fitting, the ink-receiving section 49 makes an entry into the ink outlet hole 46.

Ink flow passages (not shown), which are in communication with the respective ink-receiving sections 49 and respective cylindrical coupling tubes 71 protruding upward from the overhanging section 64*a*, are formed in the lower surface of the bottom wall 64 of the holder 50, whereby ink in the respective ink cartridges 19 can be supplied to the ink supply tubes 20. Each of the ink flow passages is formed by hermetically covering, with a film, a lower surface portion of a downwardly-opened trench section formed, in a recessed manner, in the lower surface of the bottom wall 64.

A sturdy elastic latch member for the ink cartridge 19, which is embodied by each lock arm body 67, will now be described. The lock arm body 67 assumes a flat cross-sectional profile parallel to one exterior side surface of the main body portion of the ink cartridge 19 (see FIGS. 7, 8 and 14). A tab section 72 is formed at a position higher than the engagement lugs 67*a* of the lock arm body 67. A user pinches the tab section 72 with his fingers, to thus disengage the engagement lugs 67*a* from the step section (engagement section) 192 of the ink cartridge 19, to thus cancel engagement. Moreover, a latch groove 74 for enabling latching of an upper end section 73*a* of a spring elastic body 73 to be described later is formed in the back of the tab section 72 and the back of the engagement lugs 67*a*. Support plates 75, which are independent of the lock arm bodies 67 as well as the partition walls 65, are provided upright on the bottom wall 64 of the holder 50 substantially at right angles to the lock arm bodies 67 when viewed from above. A pair of regulation protuberances 76 (restraint portion), which retain the position of a lower end portion (lower bent portion) of the spring elastic body 73 and which restrains the spring elastic body 73 upon receipt of reaction force derived from elastic deformation, horizontally project from an exterior surface of the support plate 75 (see FIGS. 7 to 9).

Figure 11:
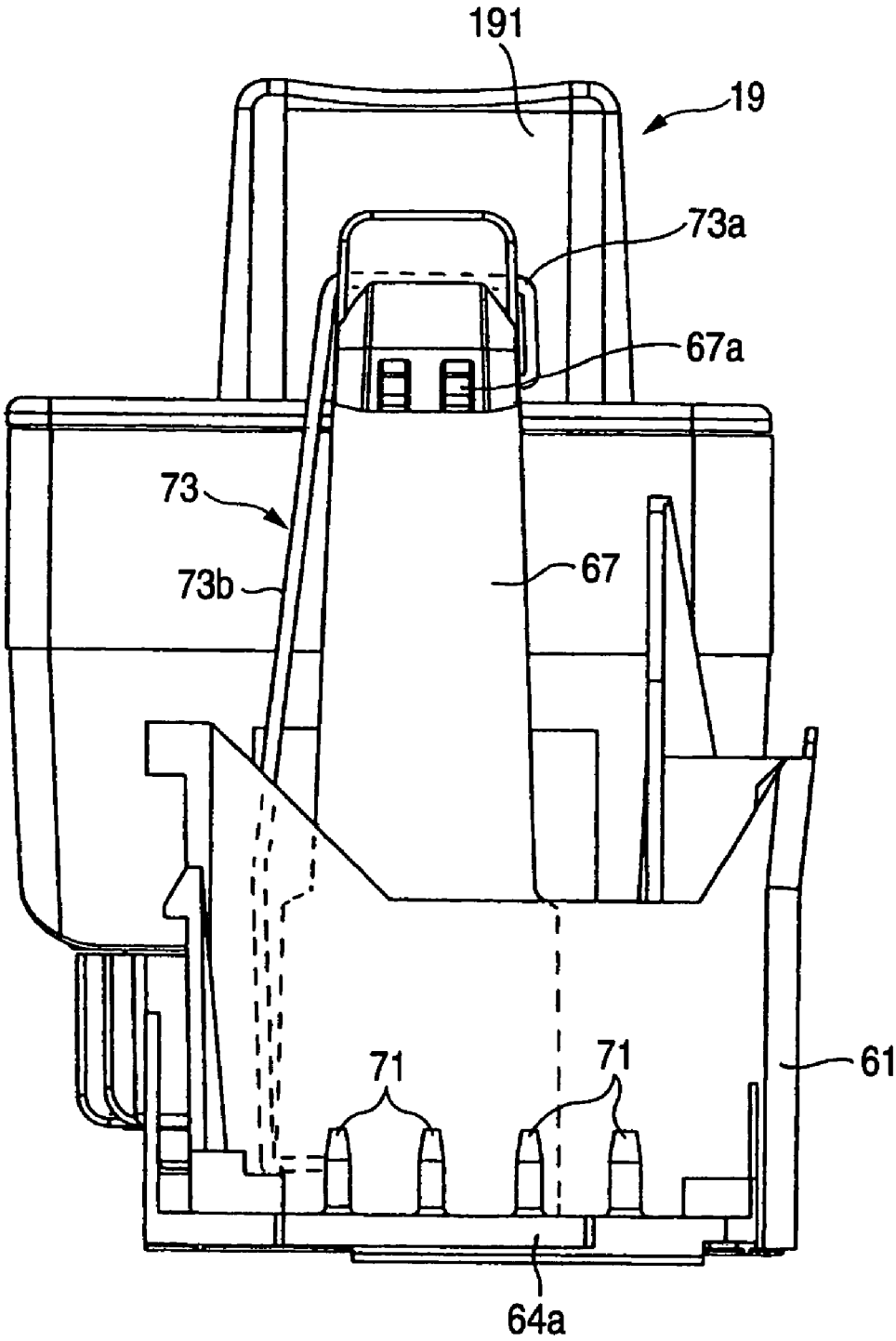
FIG. 11 is an enlarged side view taken along line XI-XI shown in FIG. 7.
Figure 12:
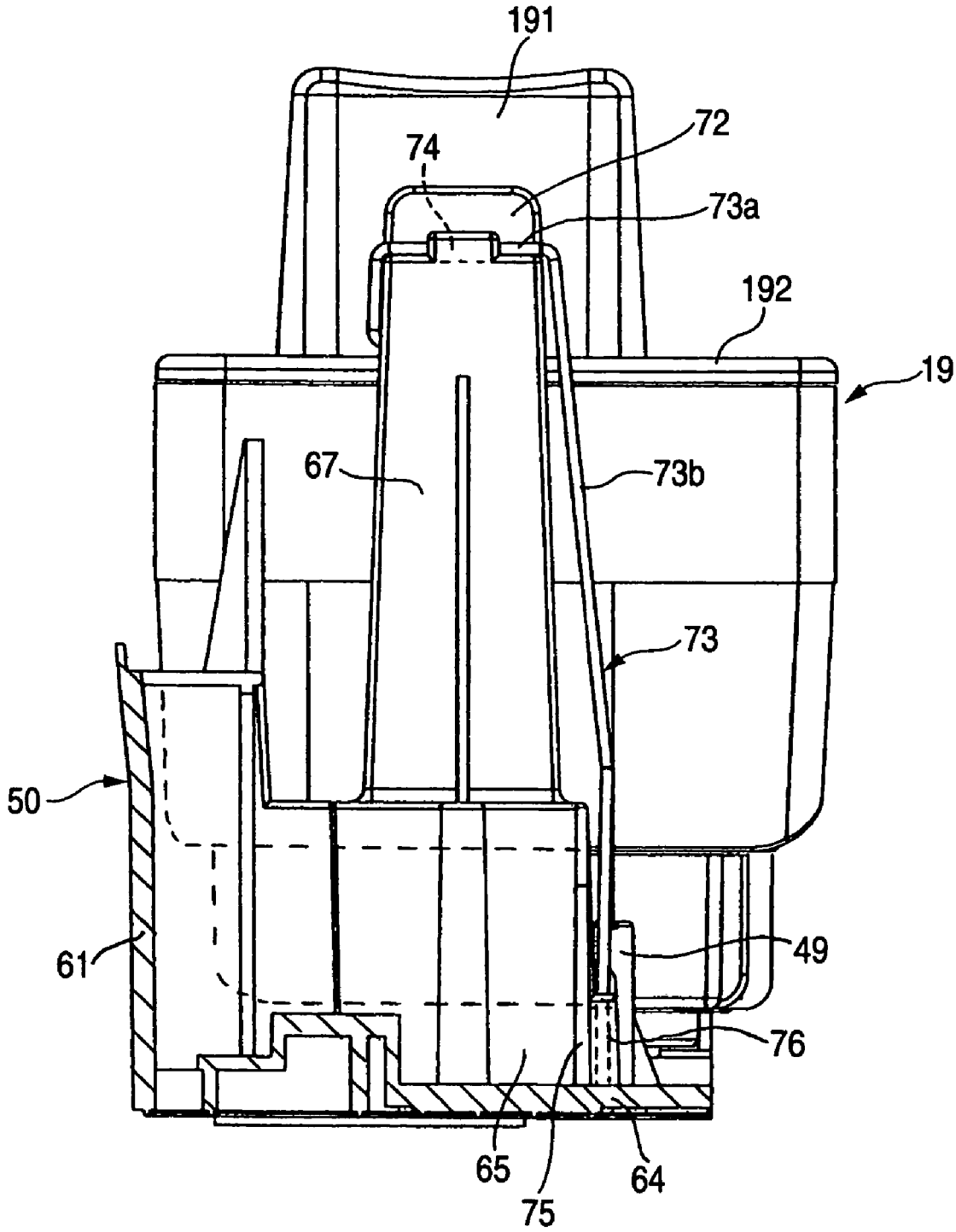
FIG. 12 is an enlarged cross-sectional view taken along line XII-XII shown in FIG. 7.
Figure 13:
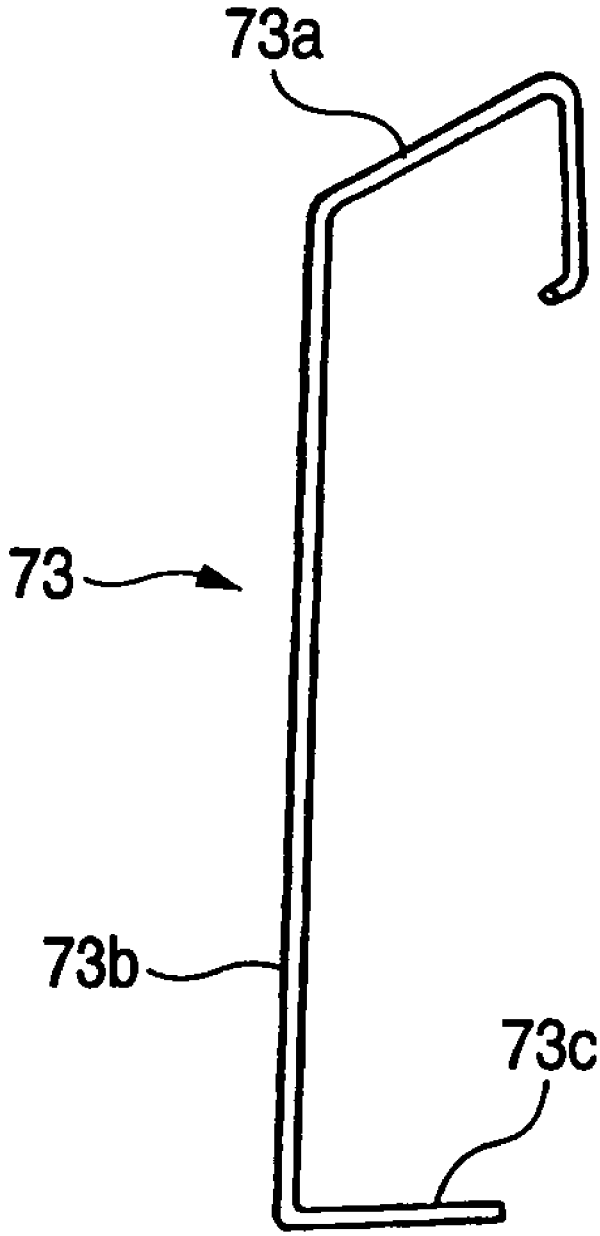
FIG. 13 is a perspective view of a spring elastic body.
Figure 14:
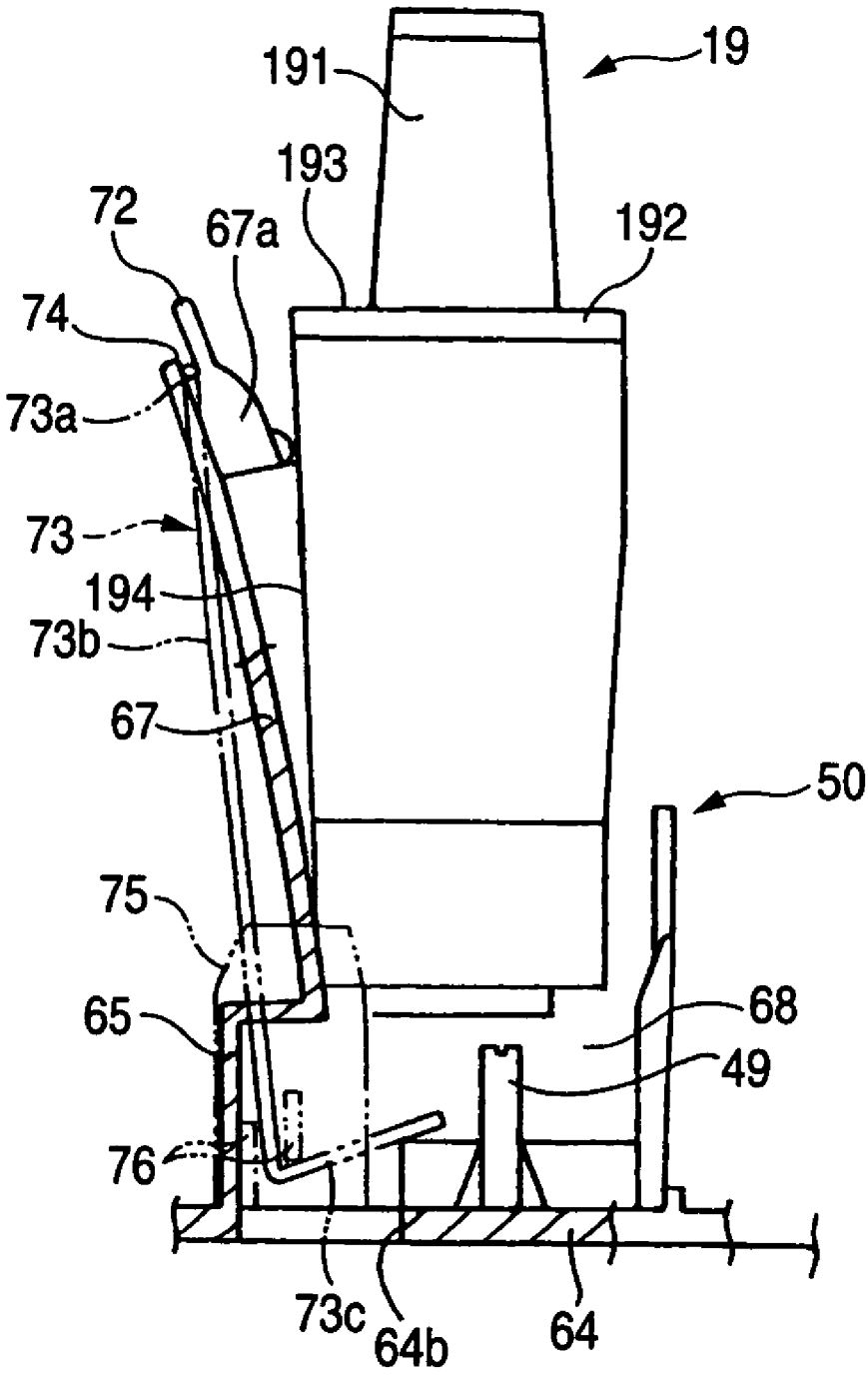
FIG. 14 is a view showing action of the spring elastic body when an ink cartridge is inserted.
Figure 15:
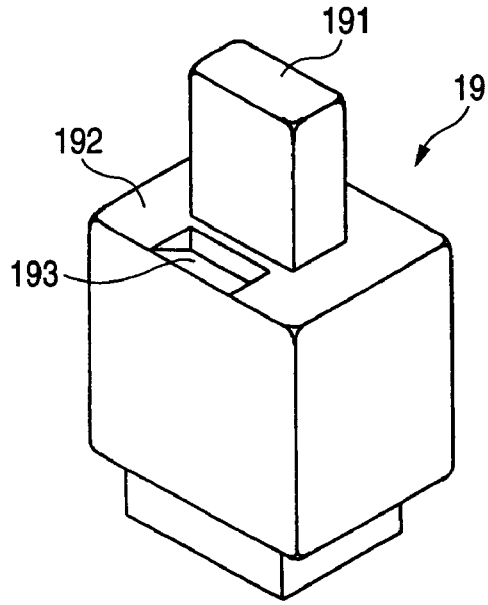
FIG. 15 is a perspective view showing an indented section 193 in a step section of the ink cartridge.

As shown in FIGS. 11, 12, and 14, the spring elastic body 73 serving as an urging member is formed by bending a spring rod made of metal into a predetermined shape. In the first embodiment, the previously-described upper end section 73*a* is downwardly bent into the shape of the letter L and is formed at an upper end of the vertically-long elastic deformation section 73*b*. A linear working section 73*c* oriented slightly upward is continually connected to the elastic deformation section 73*b* through a lower end portion (a lower bent portion) thereof. The upper end section 73*a* of the spring elastic body 73 is fitted into the latch groove 74 of the lock arm body 67. The vertically-long elastic deformation section 73*b* is arranged so as to run along the side section of the lock arm body 67. This elastic deformation section 73*b* is interposed between a pair of regulation protuberances 76 such that the working section 73*c* faces the cartridge holding chamber 68 (see solid lines in FIGS. 7 to 9).

When the lock arm body 67 stands upright while the ink cartridge 19 is not placed within the cartridge-holding chamber 68, the elastic deformation section 73*b* of the spring elastic body 73 remains linear and stays in an unacting state, where elastic actuating force does not act on the lock arm body 67.

By the above-described configuration, in an initial stage where the ink cartridge 19 is vertically inserted into the cartridge holding chamber 68, the spring elastic body 73 is elastically deformed such that, as shown in FIG. 14, the engagement lugs 67*a* of the lock arm body 67 are pushed outward (in the left direction in FIG. 14) by the one side surface (longitudinal surface) 194 of the ink cartridge 19; and such that free end of the lock arm body 67 departs from the one side surface 193 of the ink cartridge 19. In this state, since no external force acts on the working section 73*c* of the spring elastic body 73, the elastic deformation section 73*b* is linear (see a two-dot chain line shown in FIG. 14).

When the insertion action is continued to thus provide downward external force on the working section 73*c* of the spring elastic body 73 by the lower end face of the ink cartridge 19. As a result, bending stress—which attempts to broaden the angle which the axial line of the elastic deformation section 73*b* forms with the axial line of the working section 73*c*-acts on the lower end portion (the lower bent portion) of the elastic deformation section 73*b*. The placement and orientation of the lower end portion of the elastic deformation section 73*b* are regulated by the pair of regulation protuberances 76, and the placement and orientation of the upper end section 73*a* of the elastic deformation section 73*b* are also regulated by the latch groove 74. In terms of strength of materials, the positions of the pair of regulation protuberances 76 and the position of the latch groove 74 correspond to mere support points with respect to a beam. Therefore, the elastic deformation section 73*b* located between the support points is elastically deformed in the shape of a bow such that a vertically intermediate portion of the elastic deformation section 73*b* approaches the ink cartridge 19. Moreover, in terms of strength of materials, the upper end of the lock arm body 67 (an area of the lock arm body 67 close to the engagement lugs 67*a*) corresponds to a free end of a cantilever. The engagement lugs 67*a* of the lock arm body 67 are automatically deflected in such a direction as to engage with the engagement section (the step section) 192 of the ink cartridge 19, by the bending stress imparted to the spring elastic body 73. Thus, the engaged state is sturdily retained. Consequently, the upper and lower portions of the ink cartridge 19 are positioned and retained while being sandwiched between the engagement lugs 67*a* of the lock arm body 67 and the working section 73*c*. Accordingly, there is no necessity for enhancing the rigidity of the lock arm body 67 made of synthetic resin. Even when the lock arm body 67 is formed to a reduced thickness, no inconvenience is caused. Further, the spring elastic body 73 can be attached to the holder 50 later. For this reason, assembly operation is facilitated, and the elastic modulus and shape of the spring elastic body 73 can be set arbitrarily.

Conversely, when the ink cartridge 19 is removed, the tab section 72 of the lock arm body 67 is pushed by the user's fingers in such a direction as to depart from the ink cartridge 19 against the urging force of the spring elastic body 73, whereupon the engagement lugs 67*a* are disengaged from the engagement section (step section) 192 of the ink cartridge 19 and can be released from the engaged state. Moreover, the working section 73*c* of the spring elastic body 73 acts on the lower surface of the ink cartridge 19 so as to push the lower surface upward, and, therefore, operation for attaching or removing the ink cartridge 19 is extremely easy.

FIGS. 6, 7, and 8 show means for guiding the respective ink cartridges 19 so as to vertically lower and enter the holder 50 straightforward from above. One of the means corresponds to a plurality of vertically-long first guide ribs 80 projecting toward the respective cartridge holding chambers 68. The first guide ribs are formed at positions close to the air intake ports 70 serving as air introduction sections, on interior surfaces of the side wall 61 and the partition walls 65 of the holder 50.

The other means correspond to second guide ribs 81, wherein the second guide ribs are formed in parallel to the first guide ribs 80 along an interior surface of the frame body 51 which is fixedly arranged adjacent to the outer upper edge of the holder 50 and assumes a substantially rectangular shape when viewed from above. When the ink cartridge 19 is inserted while its longitudinal side surfaces are maintained in slidable contact with the guide ribs 80, 81, the second valve body 55 is brought into communication with the air intake hole 70 of the bearing surface section 69 and can be opened slightly earlier than is the first valve body 45. The reason for such settings is as follows. When the ink cartridge 19 remains not in use, the internal pressure of the ink chamber 41 is set to be lower than atmospheric pressure. If an attempt is made to simultaneously open the second valve body 55 and the first valve body 45 or to open the first valve body 45 earlier than the second valve body 55, ink is absorbed from the recording head 4 through the ink supply tube 20, which in turn break a meniscus formed in the nozzle section of the recording head 4. For this reason, breakage of the meniscus is prevented by opening the second valve body 55 first.

In order to enhance the above-described working-effect, the first guide ribs 80 are preferably arranged at positions closer to the air intake port 70 than to a line orthogonal to a midpoint on another line connecting the ink-receiving section 49 to the air intake port 70. By this arrangement, the ink cartridge 19 is inserted into the holder 50 while at least a portion thereof close to the air intake port 70 is retained in a correct position by the first and second guide ribs 80, 81.

In a state where the ink cartridge 19 remains attached to the cartridge holding chamber 68, the ink-receiving section 49 having entered the ink outlet port 46 pushes the first valve body 45 upward in the drawing, to thus open the ink outlet port 46 (see FIG. 10). As a result, the ink supply port 43 is coupled to the ink-receiving section 49, so that the ink in the ink chamber 41 can enter the ink-receiving section 49 through the ink supply port 43. In this state, the ink packing 44 comes into hermetic contact with the inner periphery of the ink supply port 43 and the outer periphery of the ink-receiving section 49, to thus seal the space present between the inner periphery of the ink supply port 43 and the outer periphery of the ink-receiving section 49. As shown in FIG. 10, the lip of the air packing 54 comes into elastic contact with an upper surface of the bearing surface section 69 while being bent inward, thereby sealing the space present between the inner periphery of the air tower 52 and the bearing surface section 69.

The ink having flowed out of the ink cartridge 19 is supplied to the recording head 4 through the ink flow passage of the holder 50 and the ink supply tube 20. The internal pressure of the ink chamber 41 drops in association with outflow of the ink. In this regard, the internal pressure of the ink chamber 41 is maintained at a level substantially equal to atmospheric pressure as a result of inflow of air from an air flow channel into the ink cartridge 19.

As shown in FIGS. 6 and 8, with a view toward preventing erroneous insertion of the ink cartridge 19, regulation projections 82 (regulation sections) assuming an substantially triangular shape when viewed from above are formed along the interior surface of the frame body 51 for each cartridge holding chamber 68. Of angular portions where longitudinal side surfaces of outer configuration of each ink cartridge 19 cross each other at substantially right angles, angular portions 83 close to the second valve body 55 and the air hole 56 are previously set so as to be heavily notched (see FIGS. 8 and 9). In contrast, angular portions of the same ink cartridge close to the first valve body 45 and the ink outlet hole 46 are previously set so as to be less notched. In correspondence with these angular portions, a pair of the regulation projections 82 are provided at corners close to the bearing surface section 69, on the interior surfaces of each cartridge holding chamber 68. By these angular portions and the projections, the ink cartridge 19 can be correctly and deeply inserted toward the bottom wall 64 of the holder 50 and latched by the lock arm body 67 only when the inserted orientation of the ink cartridge 19 is correct (i.e., the air hole 56 opposes the air intake hole 70, and the ink outlet hole 46 opposes the ink-receiving section 49). The user can readily understand that the ink cartridge 19 is blocked by the regulation projections 82 when being held in an inverted attitude and cannot be latched by the lock arm body 67. The frame body 51 is provided with partitions 84 in correspondence with the respective cartridge holding chambers 68 (see FIG. 6).

A second embodiment of the present invention will be explained by reference to FIGS. 16 and 17. The construction except for a spring elastic body 73 is as same as the construction of the first embodiment. The same members are identified by the same reference numbers. The explanation of the same members will be omitted hereinafter.

Figure 16:
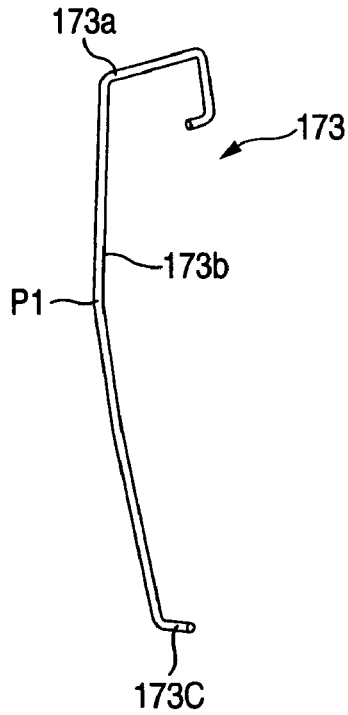
FIG. 16 is a perspective view of a spring elastic body according to second embodiment.

As shown in FIG. 16, a spring elastic body 173 as an urging member is formed by bending a metallic spring rod in a predetermined shape. The spring elastic body 173 has an upper end section 173*a*, an elastic deformation section 173*b* extending one above the other, and a lower end section 173*c* bent from and connecting to the elastic deformation section 173*b*. The elastic deformation section 173*b* has a bent portion P1.

Figure 17:
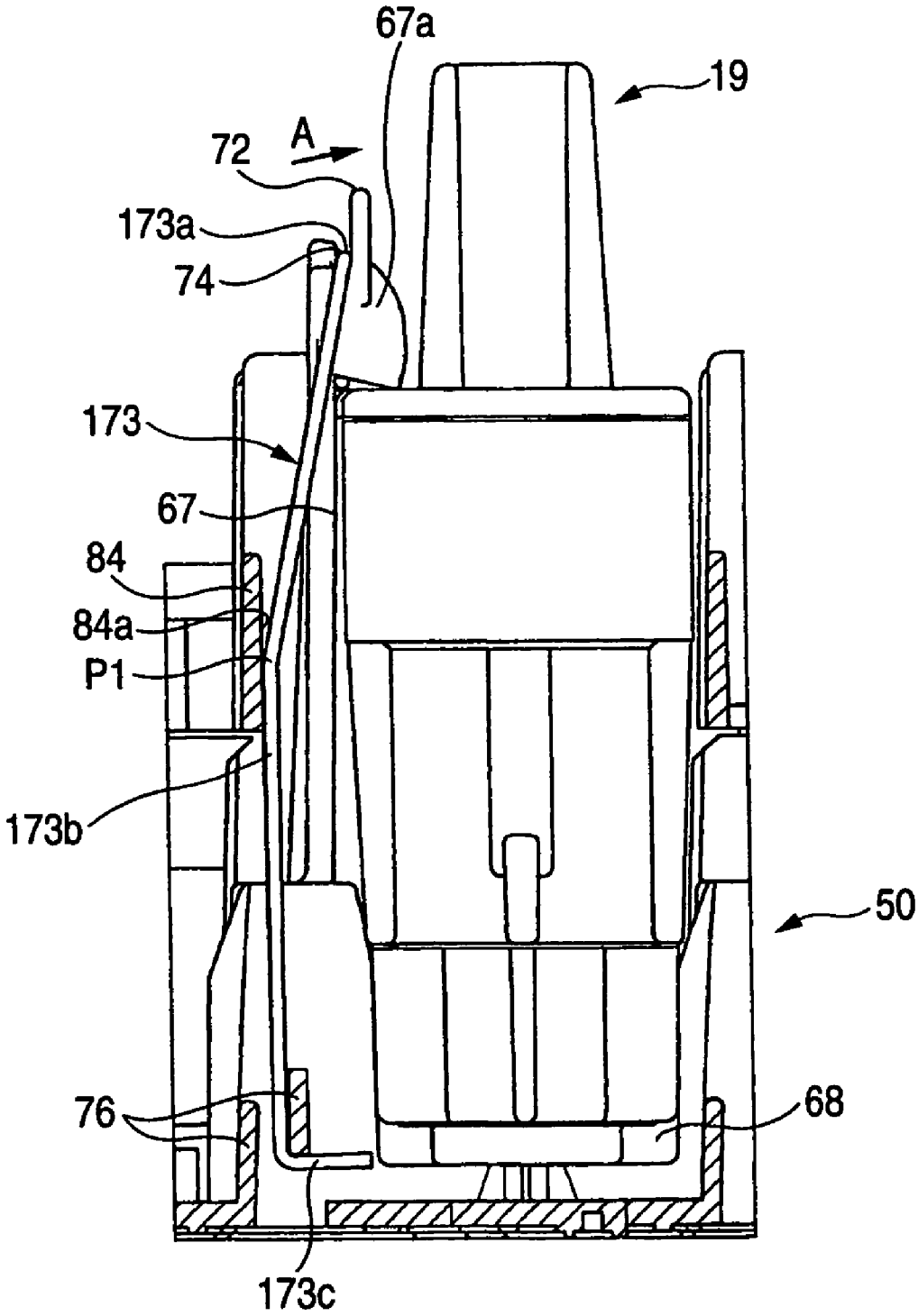
FIG. 17 is a view showing action of the spring elastic body when an ink cartridge is inserted according to the second embodiment.

As shown in FIG. 17, the upper end section 173*a* of the spring elastic body 173 is fitted into the latch groove 74 of the lock arm body 67. The elastic deformation section 173*b* extends along the side section of the lock arm body. The elastic deformation section 173*b* is interposed between a pair of regulation protuberances 76 such that the lower end section 173*c* faces the cartridge holding chamber 68. The lower end section 173*c* extends in substantially parallel with a bottom surface of the holder by a length not to interfere with the ink cartridge when the ink cartridge is inserted into the cartridge holding chamber 68.

Regardless of whether or not the ink cartridge 19 is positioned in the ink cartridge holding chamber 68, the bent portion P1 of the elastic deformation section 173*b* is in contact with the partition 84. The spring elastic body 173 urges the engagement lugs 67*a* of the lock arm body 67 in a direction of an arrow "A" as shown in FIG. 17 so that the lock arm body 67 is elastically deformed in the direction of the arrow "A". A spring contact face 84*a* where the bent portion P1 of the elastic deformation section 173*b* is in contact with the partition 84 is a rear face of the partition 84 shown in FIG. 6. In an ink cartridge holding chamber 68 closest to the one end face of the holder 50, the bent portion P1 is in contact with one end face 62 of the holder 50.

In an initial step of vertically inserting the ink cartridge 19 into the ink cartridge holding chamber 68, the engagement lugs 67*a* of the lock arm body 67 is pushed outward (in the left direction in FIG. 17) by one side surface 194 (longitudinal surface) of the ink cartridge 19. A free end of the lock arm body 67 is elastically deformed to be apart from the one side surface 194 against the urging force of the spring elastic body 173.

When the insertion is continued, the engagement lugs 67*a* are engaged with the step section (engagement section) 192. The ink cartridge 19 is positioned with an upper portion of the ink cartridge 19 pressed by the engagement lugs 67*a* of the lock arm body 67. Thus, the spring elastic body 173 is attached to the holder 50 later. For this reason, assembly operation is facilitated, and the elastic modulus and shape of the spring elastic body 173 can be set arbitrarily.

When the ink cartridge 19 is removed, the tab section 72 of the lock arm body 67 is pushed by the user's fingers in such a direction as to depart from the ink cartridge 19 against the urging force of the spring elastic body 173, whereupon the engagement lugs 67*a* are disengaged from the engagement section (step section) 192 of the ink cartridge 19 and can be released from the engagement state. Accordingly, operation for attaching or removing the ink cartridge 19 can be easily performed.

The present invention is not limited to the embodiments that have been explained through the above descriptions and the drawings. For instance, the following embodiment falls within the technical scope of the present invention. Moreover, the present invention can be practiced while being modified in various manners within the scope other than the following embodiment.

For instance, the pair of regulation projections 82 can be provided at positions close to the upper edge of the interior surface of the holder 50.

What is claimed is:

1. An image recording apparatus comprising:

an ink cartridge having an ink storage section and an ink outlet port from which ink is to be taken;

a holder to which the ink cartridge is detachably attached;

a recording section to which the ink is supplied through an ink tube coupled to the holder;

a cartridge coupling section provided on a bottom of the holder, the cartridge coupling section communicating with the ink outlet port to draw the ink from the ink cartridge when the ink cartridge is attached to the holder;

an elastically deformable lock arm body provided on the bottom of the holder, the lock arm body having an engagement lug retaining unremovably the ink cartridge attached to the holder; and an urging member formed by a spring elastic body to be engageable with the lock arm body, wherein the urging member urges the engagement lug of the lock arm body to engage the engagement lug with the ink cartridge attached to the holder, the lock arm body elastically deforming based on the urging by the urging member.

2. The image recording apparatus according to claim 1, wherein when the ink cartridge is inserted into the holder and moves along the inserting direction, the urging member elastically deforms the lock arm body in such a direction that the engagement lug engages with the ink cartridge.

3. The image recording apparatus according to claim 2, wherein the spring elastic body includes a first end portion, a second end portion, and an intermediate portion, wherein the first end portion is latched to a back face of the engagement lug of the lock arm body, wherein a bent portion formed between the intermediate portion and the second end portion is latched to a restraint portion provided on a base portion of the holder, and wherein the second end portion is formed to face an outer surface of the ink cartridge to be inserted.

4. The image recording apparatus according to claim 1, wherein regardless of whether or not the ink cartridge is inserted into the holder, the urging member elastically deforms the lock arm body in such a direction that the engagement lug crosses an inserting direction of the ink cartridge.

5. The image recording apparatus according to claim 4, wherein the spring elastic body includes a first end portion, a second end portion, and an intermediate portion, wherein the first end portion is latched to a back face of the engagement lug of the lock arm body, wherein a first bent portion formed between the intermediate portion and the second end portion is lathed to a restraint portion provided on a base portion of the holder, wherein a second bent portion is formed on the intermediate portion, and wherein the second bent portion makes contact with a plate member provided along the lock arm body on an opposite side from the engagement lug, and thereby the spring elastic body elastically deforms the lock arm body.

6. The image recording apparatus according to claim 5, wherein the plate member with which the second bent portion makes contact is one end face of the holder.

7. The image recording apparatus according to claim 5, wherein the plate member with which the second bent portion makes contact is a partition of a frame body to be attached to the holder.

8. The image recording apparatus according to claim 1, wherein the holder is formed into a single molded article, and wherein the holder has accommodating recesses which are capable of accommodating a plurality of ink cartridges for a plurality of types of ink.

9. The image recording apparatus according to claim 8, wherein the lock arm body is provided upright on the bottom of the holder and adjacent to each accommodating recess.

10. The image recording apparatus according to claim 8, wherein each ink cartridge has, in its surface to be faced with the holder, the ink outlet port and an air inlet port for taking air from outside, and wherein each accommodating recess of the holder has, in its bottom surface, the cartridge coupling section to be connected to the ink outlet port and an air introduction section to be connected to the air inlet port.

11. The image recording apparatus according to claim 10, further comprising:

a middle case; and a lower case, wherein the holder is fixedly interposed between the lower case and the middle case, and wherein a guide rib is formed closer to the air introduction section than to the cartridge coupling section on at least one of the holder and the middle case to guide each ink cartridge to be inserted straight into a corresponding accommodating recess.

12. The image recording apparatus according to claim 10, wherein a regulation section for preventing erroneous insertion of each ink cartridge is provided on at least one of the holder and the middle case.

13. The image recording apparatus according to claim 1, wherein the holder is formed into a single molded article to have an accommodating recess which is capable of accommodating the ink cartridge, and wherein the lock arm body is provided upright on the bottom of the holder and adjacent to the accommodating recess.

14. The image recording apparatus according to claim 13, wherein the ink cartridge has, in its surface to be faced with the holder, the ink outlet port and an air inlet port for taking air from outside, and wherein the accommodating recess of the holder has, in its bottom surface, the cartridge coupling section to be connected to the ink outlet port and an air introduction section to be connected to the air inlet port.

15. The image recording apparatus according to claim 14, further comprising:

a middle case; and a lower case, wherein the holder is fixedly interposed between the lower case and the middle case, and wherein a guide rib is formed closer to the air introduction section than to the cartridge coupling section on at least one of the holder and the middle case to guide the ink cartridge to be inserted straight into the accommodating recess.

16. The image recording apparatus according to claim 14, wherein a regulation section for preventing erroneous insertion of the ink cartridge is provided on at least one of the holder and the middle case.

17. An image recording apparatus for use with an ink cartridge having an ink storage section and an ink outlet port from which ink is to be taken, the image recording apparatus comprising:

a holder to which an ink cartridge can be detachably attached, the holder having an accommodating recess which is capable of accommodating the ink cartridge;

a recording section to which the ink can be supplied through an ink tube coupled to the holder;

a cartridge coupling section provided on a bottom of the holder, the cartridge coupling section being arranged to communicate with the ink outlet port to draw the ink from the ink cartridge when the ink cartridge is attached to the holder;

a lock arm body having an engagement lug for retaining the ink cartridge attached to the holder; and an urging member formed by a spring elastic body to be engageable with the lock arm body, wherein the urging member is arranged to urge the engagement lug of the lock arm body to engage the engagement lug with the ink cartridge attached to the holder, wherein the lock arm body is provided upright on the bottom of the holder and adjacent to the accommodating recess, wherein the spring elastic body includes a first end portion, a second end portion, and an intermediate portion, wherein the first end portion is latched to the back face of the engagement lug of the lock arm body, and wherein a bent portion formed between the intermediate portion and the second end portion is latched to a restraint portion provided on a base portion of the holder.

18. The image recording apparatus according to claim 17, wherein the second end portion is formed to face an outer surface of an ink cartridge being inserted.

19. The image recording apparatus according to claim 17, wherein a second bent portion is formed on the intermediate portion, and wherein the second bent portion makes contact with a plate member provided alongside the lock arm body on an opposite side from the engagement lug and thereby the spring elastic body elastically deforms the lock arm body.

* * * * *